United States Patent [19]

Pujol

[11] Patent Number: 4,722,127

[45] Date of Patent: Feb. 2, 1988

[54] METHOD OF SERVICING CONDENSATE LINE OF AN AIR CONDITIONER

[76] Inventor: Marlon P. Pujol, 8313 Garland Ave., Apt. 3, Takoma Park, Md. 20212

[21] Appl. No.: 937,489

[22] Filed: Dec. 3, 1986

[51] Int. Cl.[4] ..... B21D 53/00; B21K 29/00; B23P 15/26

[52] U.S. Cl. ..... 29/157 R; 29/402.01; 29/402.09; 29/526 R; 137/15; 285/31; 285/342; 285/348

[58] Field of Search ..... 29/157 R, 402.01, 402.09, 29/526 R; 137/15; 285/31, 16, 32, 342, 348

[56] References Cited

U.S. PATENT DOCUMENTS

| | | | |
|---|---|---|---|
| 2,344,698 | 3/1944 | Howe | 285/32 |
| 2,349,889 | 5/1944 | Steudel | 29/157 R |
| 2,532,452 | 12/1950 | Hoesel | 29/31 X |
| 2,911,235 | 11/1959 | Stumbough | 285/16 X |
| 3,437,357 | 4/1969 | Rubin | 285/342 X |
| 3,668,754 | 6/1972 | Boast | 285/342 X |
| 3,927,451 | 12/1975 | Rogers | 29/157 R |
| 4,112,567 | 9/1978 | Bretone, Jr. | 29/157 R |
| 4,186,475 | 2/1980 | Jonsson | 285/31 X |
| 4,291,903 | 9/1981 | Fields | 285/342 X |
| 4,369,911 | 1/1983 | Blumenberg | 29/157 R X |

FOREIGN PATENT DOCUMENTS

| | | | |
|---|---|---|---|
| 3320505 | 12/1984 | Fed. Rep. of Germany | 29/402.01 |

*Primary Examiner*—Charlie T. Moon

*Attorney, Agent, or Firm*—Fay, Sharpe, Beall, Fagan, Minnich & McKee

[57] ABSTRACT

For servicing clogged air conditioner condensate lines, a coupling assembly is disclosed that provides access to the clogged line. The coupling assembly is adapted for fitting a plurality of differently sized condensate lines. Once connected to the condensate lines, an adapter fitting of the coupling assembly can be used for clearing the line with compressed air. The cut condensate line is then reconnected so that it may continue to a drain the condensate that collects in the drain pan.

1 Claim, 4 Drawing Figures

METHOD OF SERVICING CONDENSATE LINE OF AN AIR CONDITIONER

BACKGROUND OF THE INVENTION

The invention relates to a coupling assembly, for servicing clogged air conditioner condensate lines by providing an adaptor fitting that can be connected to the condensate line and used for blowing out the line with compressed air or Freon®.

Air conditioners cool and dehumidify the warm humid air of a dwelling. The air passes through heat exchanger coils thereby reducing its temperature and water vapor content. The water vapor in the humid feed air condenses onto the cold coils of the heat exchanger. The resultant condensate collects in a drain pan and is drained from the exchange unit by a condensate line that typically extends outside of the dwelling being cooled or into a drain that is connected to a sewer system.

The humid air is pulled from the dwelling through a return ducting network. Therefore, the air is typically laden with airborne dust and lint particles that become mixed with the condensate that is drained from the heat exchanging unit. The condensate usually flows at low velocity out of the drain pan through the line and into a drain. As a result, the dust and lint that collects in the condensate periodically builds up in the condensate line to clog the flow. This results in the drain pan spilling over with water and the subsequent flooding of water onto the floor adjacent the exchange unit.

In many installations, the condensate line is brazed or welded directly to the drain pan. The tubing used for the condensate line is of a relatively small diameter since it is not necessary that the tubing handle a great volume of condensate. Therefore, it is not generally possible to snake out a condensate line, particularly in domestic installations. It is also not generally possible to blow out the line from the opening at the drain pan, since access to the opening of the condensate line is limited.

Usually to clear a clogged condensate line, the condensate line is cut and a source of high pressure fluid is forced down the line. In the field, however, there is little time available to adequately connect the source of high pressure to the cut line so that leakage does not result. Freon, which is readily available from a portable tank at high pressure, or an air compressor is often used. Typically, the compressed air line is connected to the condensate line with duct tape and hand held with pressure on the taped joint to prevent leakage. Leakage inevitably results, however, and therefore this method is inefficient in practice. After the line has been cleared, the cut ends are joined together by a suitable coupling.

SUMMARY OF INVENTION

It is an object of the the invention to overcome the prior art methods of flushing or unclogging a condensate lines which involve connecting a source of high pressure to a cut condensate line by a joint secured with tape.

It is an object of the invention to provide a coupling assembly and adaptor that can be readily fixed to a condensate line for efficiently connecting a source of high pressure to the line without leakage at the joint.

It is a further object of the invention to provide a method for clearing a clogged condensate line by cutting the line, fixing a coupling adaptor to the cut line without leakage, and applying a source of high pressure fluid through the coupling adaptor to the line for clearing the line. The coupling adaptor is fixed at one end to the condensate line and at the other end is provided with a standard threaded fitting such as a Schrader fitting, which readily accepts standard air compressor or Freon® tank hose fittings.

It is an object of the invention to provide a coupling assembly having a coupling body, a compression nut, a wedge washer and a flat washer. The coupling body has at one end a blunt right angle wedge washer engaging face and a threaded external cylindrical portion for engaging the nut. At the other end of the coupling body is a reduced end portion for accomodating a standard threaded fitting such as a Schrader fitting.

It is an object of the invention to accomodate several different sized condensate pipe diameters with the same coupling body and coupling nut by providing a wedge washer and flat washer in different sizes. The pipe diameters that can be coupled with the coupling apparatus preferably range from $\frac{1}{4}''$ O.D. to $\frac{5}{8}''$ O.D. and the appropriate combination of flat and wedge washers is selected for the particular condensate line to be serviced.

DESCRIPTION OF THE PREFERRED EMBODIMENTS

As a part of the regular maintenance of an air conditioner system, the condensate line should be flushed or cleared since particulate matter can build up in the line as a result of the low flow rates in the line. Occasionally condensate lines become clogged and must be blown out since the internal diameter of the pipe is usually too small to accomodate a snake. In the typical installation, the condesate line is not provided with an access port for servicing and therefore the line is usually cut at a point near the drain pan to provide access.

Figure 1:
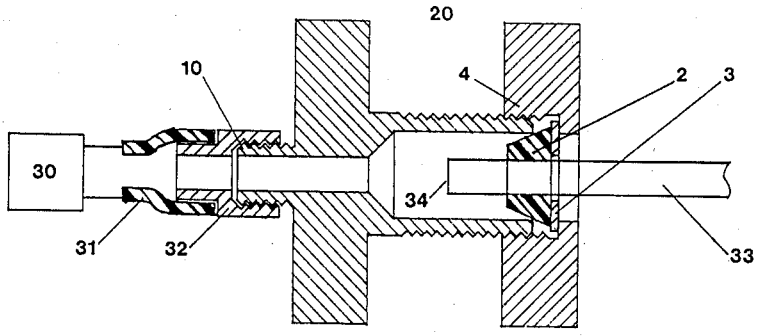
FIG. 1 is a cross-section view of the coupling apparatus coupled to a condensate line at one end and to a source of high pressure at the other end.

In FIG. 1, a partial length of a cut condensate line 33 is shown. A coupling apparatus designated generally at 20 receives the end portion 34 of cut line 33. As explained in further detail hereinafter, coupling apparatus 20 is securely joined to line 33 without leakage. At the other end of the coupling apparatus, is a standard threaded fitting 10, such as Schrader fitting. Connected to fitting 10 is a source of high pressure 30, indicated schematically. The source of high pressure may be a tank of Freon® gas, an electric air compressor, or a hand pump. The pressure needs to be sufficient to "blow out" any clogged portions of the line. The high pressure source 30 is connected to fitting 10 by a suitable hose 31 having a standarad coupling to fitting.

As the source of high pressure is applied to the coupling apparatus, the pressure builds within line 33 forcing the foreign matter out of the condensate line and through the outlet. After the line has been flushed or cleared, the cut end portions of the line can be joined together. A short section of hose having a suitable diameter that snugly fits over each cut end of the line can be used. The hose is then clamped in place with hose clamps, for example.

Figure 2:
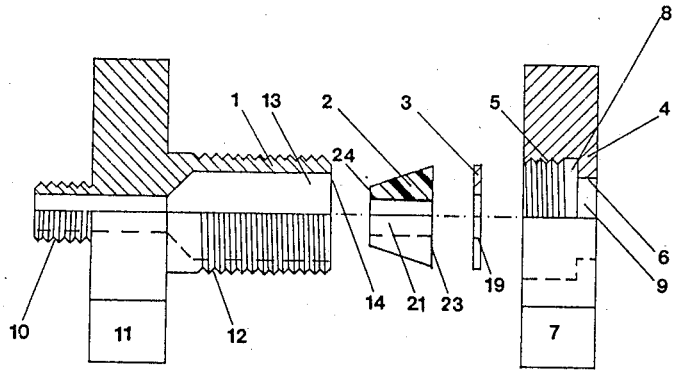
FIG. 2 is a view a of a partial cross section of the coupling assembly of FIG. 1 showing the components in an exploded position.
Figure 3:
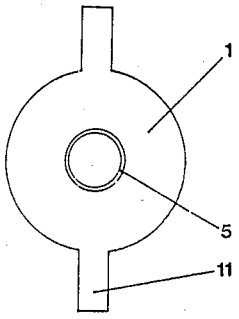
FIG. 3 an end view of the coupling body shown in FIG. 2.

Coupling apparatus 20 is well suited for coupling a source of high pressure to a cut line. As shown in FIGS. 1 and 2, a coupling body member 1 is provided with an internal through bore 13. Externally, coupling member 10 is provided with a threaded portion 12 opposite fitting 10 and radial flanges 11, as best seen in FIG. 3. Radial flanges 11 enable a user to prevent rotation of the coupling body during assembly of the coupling apparatus.

Figure 4:
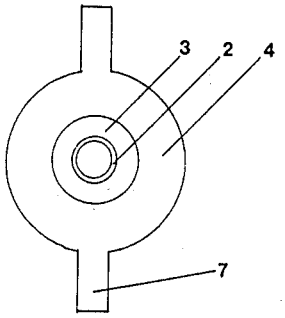
FIG. 4 is an end view of the coupling nut, flat washer and wedge washer of FIG. 2 assembled together in alignment.

Compression nut 4, also seen in FIGS. 1, 2 and in end view in FIG. 4, is provided with an internally threaded bore 5 truncated at circular flange 6. Adjacent flange 6 is a flat washer seat 8. A condesate line or pipe receving opening is provided at 9. Opening 9 is large enough to receive a predetermined maximum diameter condensate line, which for example is about ⅝" O.D. Radial flanges 7 are used for tightening compression nut 4 on coupling member 1, the threaded portion 12 of member 1 being threadedly received in threaded bore 5.

In order to seal the joint between condensate line 33 and coupling apparatus 20, a wedge washer 2 is provided having a frusto conical shape with tapered outer surface 22 extending between an end portion 24 and a flat washer engaging end surface 23. A flat washer 3 is further provided to abut end 23 to support wedge washer 2 from deforming past flange 6 and through opening 9 when axially or longitudinally compressed. Washers 2 and 3 are selected such that the internal diameter of their respective through bores 21 and 19 are only slightly larger than the O.D. of the condensate line which the apparatus is connected to. Further, in a preferred embodiment, flat washer 3 has an external diameter bore 19 that is slightly greater than the internal diameter bore 21 of wedge washer 2, as seen from the end view shown in FIG. 4.

In use of the coupling apparatus, the condensate line is cut. The compression nut 4 is placed over the cut end 34 of ,the line, as shown in FIG. 1, with bore 5 facing outwardly toward end 34. Flat washer 3 is then placed over the end 34 followed by wedge washer 2. The flat washer and wedge washer are selected to be of a size such that the internal diameters of the washers closely approximate the O.D. of line 33 as aforementioned.

End 34 need only extend past wedge washer 3 a distance sufficient to allow line 33, to be clamped by the wedge washer when it is axially compressed. To compress wedge washer 3, compression nut 4 is tightened onto threaded portion 12 of coupling member 1 such that a portion of the tapered outer surface of wedge washer 3 is forced into contact with a blunt, right angle compression washer engaging surface 14. Surface 14 may be slightly rounded, but-in a preferred embodiment, surface 14 is perpendicular to threaded portion 12 to provide a wedge washer engaging surface that quickly deforms wedge washer 3 as a result shortening the axial or longitudinal distance between surface 14 and flange 6 by turning compression nut 4. It is further preferred that surface 14 be perpendicular so that coupling member 1 is easily machined. If coupling member 1 is machined from metal, the surface 14 need only be deburred to provide a suitable wedge washer engaging surface.

As nut 4 is tightened, flat washer 2 prevents wedge washer 3 from deforming axially and as a result the wedge washer is deformed radially, clamping condensate line 33 evenly so as to provide a joint without leakage. After the line has been cleared, the coupling apparatus 20 can be disconnected. It is preferred, that wedge 2 be constructed of a resilient material, such as an elastomeric synthetic resin material that allows the coupling apparatus to be used repeatedly without permanent deformation to the wedge washer.

Although it is intended that the coupling apparatus be used in servicing air conidtioner condensate lines, it is regonized that the invention is defined by the appended claims and not limited by the foregoing description of the preferred embodiment.

What is claimed is:

1. A method for servicing a condensate line for an air conditioner, comprising the steps of:

cutting a condensate line to obtain access thereto;

connecting an adapter to the condensate line, said adapter having a body member having opposite ends, wherein one of said ends has a Schrader fitting and the other of said ends has an externally threaded shank portion, said body member having an internal through bore extending between said ends;

sliding a compression nut having opposite ends and an internal bore through one of said ends, and a larger bore in the other said ends, over said condensate line through said one of said ends;

placing a frusto conical compression washer having a bore, a first diameter end surface and a second diameter end surface, wherein said bore has a diameter approximately equal to the outer diameter of the condensate line to serviced, over said condensate line, and positioning said compression washer between said body member and said compression nut;

providing said compression nut with an internally threaded portion adapted to threadedly engaged said cxternally threaded shank portion of said body member;

providing said body member with a circular compression washer engaging surface having an internal diameter greater than said first diameter of said compression washer and less than said second diameter of said compression washer, engaging said circular engaging surface of said body member in contact with said compression washer and tightening said compression nut on said threaded shank such that said second surface of said compression washer contacts said compression nut for radially and longitudinally compressing said compression washer during the tightening of said nut;

connecting a source of high pressure fluid to said Schrader fitting for clearing said line of debris; and disconnecting said adapter from said condensate line; and reconnecting the nut ends of the cleared condensate line.

* * * * *